United States Patent [19]

Tomaszewski

[11] 4,392,922

[45] Jul. 12, 1983

[54] TRIVALENT CHROMIUM ELECTROLYTE AND PROCESS EMPLOYING VANADIUM REDUCING AGENT

[75] Inventor: Thaddeus W. Tomaszewski, Dearborn, Mich.

[73] Assignee: Occidental Chemical Corporation, Warren, Mich.

[21] Appl. No.: 205,406

[22] Filed: Nov. 10, 1980

[51] Int. Cl.[3] ..... C25D 3/06

[52] U.S. Cl. ..... 204/51

[58] Field of Search ..... 204/43 R, 51, 105 R; 148/6.2

[56] References Cited

U.S. PATENT DOCUMENTS

| | | | |
|---|---|---|---|
| 1,795,459 | 3/1931 | Westbrook | 204/51 |
| 2,739,109 | 3/1956 | Quaely | 204/43 R |
| 2,824,829 | 2/1958 | Quaely | 204/43 R |
| 3,954,574 | 5/1976 | Gyllenspetz et al. | 204/43 T |
| 4,184,929 | 1/1980 | Tomaszewski et al. | 204/51 |

FOREIGN PATENT DOCUMENTS

| | | | |
|---|---|---|---|
| 711181 | 1/1980 | U.S.S.R. | 204/43 R |

OTHER PUBLICATIONS

J. K. Dennis et al., "Nickel and Chromium Plating", pp. 185–186, (1972).

*Primary Examiner*—G. L. Kaplan
*Attorney, Agent, or Firm*—Richard P. Mueller

[57] ABSTRACT

An aqueous acidic trivalent chromium electrolyte and process for electrodepositing chromium platings comprising an electrolyte containing trivalent chromium ions, a complexing agent, halide ions, ammonium ions and a reducing agent comprising vanadium ions present in an amount effective to maintain the concentration of hexavalent chromium ions formed in the bath at a level at which satisfactory chromium electrodeposits are obtained.

35 Claims, No Drawings

TRIVALENT CHROMIUM ELECTROLYTE AND PROCESS EMPLOYING VANADIUM REDUCING AGENT

BACKGROUND OF THE INVENTION

Chromium electroplating baths are in widespread commercial use for applying protective and decorative platings to metal substrates. For the most part, commercial chromium plating solutions heretofore used employ hexavalent chromium derived from compounds such as chromic acid, for example, as the source of the chromium constituent. Such hexavalent chromium electroplating solutions have long been characterized as having limited covering power and excessive gassing particularly around apertures in the parts being plated which can result in incomplete coverage. Such hexavalent chromium plating solutions are also quite sensitive to current interruptions resulting in so-called "whitewashing" of the deposit.

Because of these and other problems including the relative toxicity of hexavalent chromium, and associated waste disposal problems, extensive work has been conducted in recent years to develop chromium electrolytes incorporating trivalent chromium providing numerous benefits over the hexavalent chromium electrolytes heretofore known. According to the present invention a novel trivalent chromium electrolyte and process for depositing chromium platings has been discovered by which bright chromium deposits are produced having a color equivalent to that obtained from hexavalent chromium baths. The electrolyte and process of the present invention further provides electroplating employing current densities which vary over a wide range without producing the burning associated with deposits plated from hexavalent chromium plating baths; in which the electrolyte composition minimizes or eliminates the evolution of mist or noxious odors during the plating process; the electrolyte and process provides for excellent coverage of the substrate and good throwing power; current interruptions during the electroplating cycle do not adversely affect the chromium deposit enabling parts to be withdrawn from the electrolyte, inspected, and thereafter returned to the bath for continuation of the electroplating cycle; the electrolyte employs low concentrations of chromium thereby reducing the loss of chromium due to drag-out; and waste disposal of the chromium is facilitated in that the trivalent chromium can readily be precipitated from the waste solutions by the addition of alkaline substances to raise the pH to about 8 or above.

The electrolyte of the present invention further incorporates a reducing agent to prevent the formation of detrimental concentrations of hexavalent chromium during bath operation which heretofore has interfered with the efficient electrodeposition of chromium from trivalent chromium plating baths including the reduction in the efficiency and covering power of the bath. In some instances, the buildup of detrimental hexavalent chromium has occurred to the extent that a cessation in electrodeposition of chromium has occurred necessitating a dumping and replacement of the electrolyte. In accordance with a further discovery of the present invention, it has been found that the addition of the reducing agent according to the electrolyte herein disclosed effects a rejuvenation of an electrolyte contaminated with excessive hexavalent chromium restoring the plating efficiency and throwing power of such a bath and avoiding the costly and time consuming step of dumping and replacing the electrolyte.

SUMMARY OF THE INVENTION

The benefits and advantages of the present invention in accordance with the composition aspects thereof are achieved by an aqueous acidic electrolyte containing as its essential constituents, controlled amounts of trivalent chromium, a complexing agent present in an amount sufficient to form a chromium complex, halide ions, ammonium ions and a reducing agent comprising vanadium ions present in an amount effective to maintain the concentration of hexavalent chromium ions at a level below that at which continued optimum efficiency and throwing power of the electroplating bath is maintained. More particularly, the electrolyte can broadly contain about 0.2 to about 0.8 molar trivalent chromium ions, a formate and/or acetate complexing agent present in an amount in relationship to the concentration of the chromium constituent and typically present in a molar ratio of complexing agent to chromium ions of about 1:1 to about 3:1, a bath soluble and compatible vanadium salt present in a concentration to provide a vanadium ion concentration of at least about 0.015 grams per liter (g/l) up to about 6.3 g/l as a reducing agent for any hexavalent chromium formed during the electroplating process, ammonium ions as a secondary complexing agent present in a molar ratio of ammonium to chromium of about 2.0:1 to about 11:1, halide ions, preferably chloride and bromide ions present in a molar ratio of halide to chromium ions of about 0.8:1 to about 10:1; one or a combination of bath soluble salts to increase bath conductivity comprising compatible simple salts of strong acids such as hydrochloric or sulfuric acid and alkaline earth, alkali and ammonium salts thereof of which sodium fluoborate comprises a preferred conductivity salt, and hydrogen ions present to provide an acidic electrolyte having a pH of about 2.5 up to about 5.5.

The electrolyte may optionally, but preferably, also contain a buffering agent such as boric acid typically present in a concentration up to about 1 molar, a wetting agent present in small but effective amounts of the types conventionally employed in chromium or nickel plating baths as well as controlled effective amounts of anti-foaming agents. Additionally, the bath may incorporate other dissolved metals as an optional constituent including iron, cobalt, nickel, manganese, tungsten or the like in such instances in which a chromium alloy deposit is desired.

In accordance with the process aspects of the present invention, the electrodeposition of chromium on a conductive substrate is performed employing the electrolyte at a temperature ranging from about 15° to about 45° C. The substrate is cathodically charged and the chromium is deposited at current densities ranging from about 50 to about 250 amperes per square foot (ASF) usually employing insoluble anodes such as carbon, platinized titanium or platinum. The substrate, prior to chromium plating, is subjected to conventional pretreatments and preferably is provided with a nickel plate over which the chromium deposit is applied.

In accordance with a further process aspect of the present invention, electrolytes of the trivalent chromium type which have been rendered inoperative or inefficient due to the accumulation of hexavalent chromium ions, are rejuvenated by the addition of controlled effective amounts of the vanadium reducing agent to reduce the hexavalent chromium concentration to levels below about 100 parts per million (ppm), and preferably below 50 ppm at which efficient chromium plating can be resumed.

Additional benefits and advantages of the present invention will become apparent upon a reading of the description of the preferred embodiments and the specific examples provided.

DESCRIPTION OF THE PREFERRED EMBODIMENTS

In accordance with the composition aspects of the present invention, the trivalent chromium electrolyte contains, as one of its essential constituents, trivalent chromium ions which may broadly range from about 0.2 to about 0.8 molar, and preferably from about 0.4 to about 0.6 molar. Concentrations of trivalent chromium below about 0.2 molar have been found to provide poor throwing power and poor coverage in some instances whereas, concentrations in excess of about 0.8 molar have in some instances resulted in precipitation of the chromium constituent in the form of complex compounds. For this reason it is preferred to maintain the trivalent chromium ion concentration within a range of about 0.2 to about 0.8 molar, and preferably from about 0.4 to about 0.6 molar. The trivalent chromium ions can be introduced in the form of any simple aqueous soluble and compatible salt such as chromium chloride hexahydrate, chromium sulfate, and the like. Preferably, the chromium ions are introduced as chromium sulfate for economic considerations.

A second essential constituent of the electrolyte is a complexing agent for complexing the chromium constituent present maintaining it in solution. The complexing agent employed should be sufficiently stable and bound to the chromium ions to permit electrodeposition thereof as well as to allow precipitation of the chromium during waste treatment of the effluents. The complexing agent may comprise formate ions, acetate ions or mixtures of the two of which the formate ion is preferred. The complexing agent can be employed in concentrations ranging from about 0.2 up to about 2.4 molar as a function of the trivalent chromium ions present. The complexing agent is normally employed in a molar ratio of complexing agent to chromium ions of from about 1:1 up to about 3:1 with ratios of about 1.5:1 to about 2:1 being preferred. Excessive amounts of the complexing agent such as formate ions is undesirable since such excesses have been found in some instances to cause precipitation of the chromium constituent as complex compounds.

A third essential constituent of the electrolyte comprises a reducing agent in the form of bath soluble and compatible vanadium salts present in an amount to provide a vanadium ion concentration of at least about 0.015 g/l up to about 6.3 g/l. Excess amounts of vanadium do appear to adversely effect the operation of the electrolyte in some instances causing dark striations in the plate deposit and a reduction in the plating rate. Typically and preferably, vanadium concentrations of from about 0.2 up to about 1 g/l are satisfactory to maintain the hexavalent chromium concentration in the electrolyte below about 100 ppm, and more usually from about 0 up to about 50 ppm at which optimum efficiency of the bath is attained.

The vanadium reducing agent is introduced into the electrolyte by any one of a variety of vanadium salts including those of only minimal solubility in which event mixtures of such salts are employed to achieve the required concentration. The vanadium salt may comprise any one of a variety of salts which do not adversely effect the chromium deposit and include, for example, sodium metavanadate ($NaVO_3$); sodium orthovanadate ($Na_3VO_4$, $Na_3VO_4.10H_2O$, $Na_3VO_4.16H_2O$); sodium pyrovanadate ($Na_4V_2O_7$); vanadium pentoxide ($V_2O_5$); vanadyl sulfate ($VOSO_4$); vanadium trioxide ($V_2O_3$); vanadium di-tri or tetra chloride ($VCl_2$, $VCl_3$, $VCl_4$); vanadium tri-fluoride ($VF_3.3H_2O$); vanadium tetrafluoride ($VF_4$); vanadium pentafluoride ($VF_5$); vanadium oxy bromide ($VOBr$); vanadium oxy di- or tri-bromide ($VOBr_2$, $VOBr_3$); vanadium tribromide ($VBr_3$); ammonium metavanadate ($NH_4VO_3$); ammonium vanadium sulfate ($NH_4V(SO_4)_2.12H_2O$); lithium metavanadate ($LiVO_3.2H_2O$; potassium metavanadate ($KVO_3$); thallium pyrovanadate ($Tl_4VO_7$); thallium metavanadate ($TlVO_3$), as well as mixtures thereof.

In as much as the trivalent chromium salts, complexing agent, and vanadium salts do not provide adequate bath conductivity by themselves, it is preferred to further incorporate in the electrolyte controlled amounts of conductivity salts which typically comprise salts of alkali metal or alkaline earth metals and strong acids such as hydrochloric acid and sulfuric acid. The inclusion of such conductivity salts is well known in the art and their use minimizes power dissipation during the electroplating operation. Typical conductivity salts include potassium and sodium sulfates and chlorides as well as ammonium chloride and ammonium sulfate. A particularly satisfactory conductivity salt is fluoboric acid and the alkali metal, alkaline earth metal and ammonium bath soluble fluoborate salts which introduce the fluoborate ion in the bath and which has been found to further enhance the chromium deposit. Such fluoborate additives are preferably employed to provide a fluoborate ion concentration of from about 4 to about 300 g/l. It is also typical to employ the metal salts of sulfamic and methane sulfonic acid as a conductivity salt either alone or in combination with inorganic conductivity salts. Such conductivity salts or mixtures thereof are usually employed in amounts up to about 300 g/l or higher to achieve the requisite electrolyte conductivity and optimum chromium deposition.

It has also been observed that ammonium ions in the electrolyte are beneficial in enhancing the reducing efficiency of the vanadium constituent for converting hexavalent chromium formed to the trivalent state. Particularly satisfactory results are achieved at molar ratios of total ammonium ion to chromium ion ranging from about 2.0:1 up to about 11:1, and preferably, from about 3:1 to about 7:1. The ammonium ions can in part be introduced as the ammonium salt of the complexing agent such as ammonium formate, for example, as well as in the form of supplemental conductivity salts.

The effectiveness of the vanadium reducing agent in controlling hexavalent chromium formation is also enhanced by the presence of halide ions in the bath of which chloride and bromide ions are preferred. The use of a combination of chloride and bromide ions also inhibits the evolution of chlorine at the anode. While iodine can also be employed as the halide constituent, its relatively higher cost and low solubility render it less desirable than chloride and bromide. Generally, halide concentrations of at least about 15 g/l have been found necessary to achieve sustained efficient electrolyte operation. More particularly, the halide concentration is controlled in relationship to the chromium concentration present and is controlled at a molar ratio of about 0.8:1 up to about 10:1 halide to chromium, with a molar ratio of about 2:1 to about 4:1 being preferred.

In addition to the foregoing constituents, the bath optionally but preferably also contains a buffering agent in an amount of about 0.15 molar up to bath solubility, which amounts typically ranging up to about 1 molar. Preferably the concentration of the buffering agent is controlled from about 0.45 to about 0.75 molar calculated as boric acid. The use of boric acid as well as the alkali metal and ammonium salts thereof as the buffering agent also is effective to introduce borate ions in the electrolyte which have been found to improve the covering power of the electrolyte. In accordance with a preferred practice, the borate ion concentration in the bath is controlled at a level of at least about 10 g/l. The upper level is not critical and concentrations as high as 60 g/l or higher can be employed without any apparent harmful effect.

The bath further incorporates as an optional but preferred constituent, a wetting agent or mixture of wetting agents of any of the types conventionally employed in nickel and hexavalent chromium electrolytes. such wetting agents or surfactants may be anionic or cationic and are selected from those which are compatible with the electrolyte and which do not adversely affect the electrodeposition performance of the chromium constituent. Typically, wetting agents which can be satisfactorily employed include sulphosuccinates or sodium lauryl sulfate and alkyl ether sulfates alone or in combination with other compatible anti-foaming agents such as octyl alcohol, for example. The presence of such wetting agents has been found to produce a clear chromium deposit eliminating dark mottled deposits and providing for improved coverage in low current density areas. While relatively high concentrations of such wetting agents are not particularly harmful, concentrations greater than about 1 gram per liter have been found in some instances to produce a hazy deposit. Accordingly, the wetting agent when employed is usually controlled at concentrations less than about 1 g/l, with amounts of about 0.05 to about 1 g/l being typical.

It is also contemplated that the electrolyte can contain other metals including iron, manganese, and the like in concentrations of from 0 up to saturation or at levels below saturation at which no adverse effect on the electrolyte occurs in such instances in which it is desired to deposit chromium alloy platings. When iron is employed, it is usually preferred to maintain the concentration of iron at levels below about 0.5 g/l.

The electrolyte further contains a hydrogen ion concentration sufficient to render the electrolyte acidic. The concentration of the hydrogen ion is broadly controlled to provide a pH of from about 2.5 up to about 5.5 while a pH range of about 3.5 to 4.0 is particularly satisfactory. The initial adjustment of the electrolyte to within the desired pH range can be achieved by the addition of any suitable acid or base compatible with the bath constituents of which hydrochloric or sulfuric acid and/or ammonium or sodium carbonate or hydroxide are preferred. During the use of the plating solution, the electrolyte has a tendency to become more acidic and appropriate pH adjustments are effected by the addition of alkali metal and ammonium hydroxides and carbonates of which the ammonium salts are preferred in that they simultaneously replenish the ammonium constituent in the bath.

In accordance with the process aspects of the present invention, the electrolyte as hereinabove described is employed at an operating temperature ranging from about 15° to about 45° C., preferably about 20° to about 35° C. Current densities during electroplating can range from about 50 to 250 ASF with densities of about 75 to about 125 ASF being more typical. The electrolyte can be employed to plate chromium or conventional ferrous or nickel substrates and on stainless steel as well as nonferrous substrates such as aluminum and zinc. The electrolyte can also be employed for chromium plating plastic substrates which have been subjected to a suitable pretreatment according to well-known techniques to provide an electrically conductive coating thereover such as a nickel or copper layer. Such plastics include ABS, polyolefin, PVC, and phenol-formaldehyde polymers. The work pieces to be plated are subjected to conventional pretreatments in accordance with prior art practices and the process is particularly effective to deposit chromium platings on conductive substrates which have been subjected to a prior nickel plating operation.

During the electroplating operation, the work pieces are cathodically charged and the bath incorporates a suitable anode of a material which will not adversely effect and which is compatible with the electrolyte composition. For this purpose anodes of an inert material such as carbon, for example, are preferred although other inert anodes of platinized titanium or platinum can also be employed. When a chromium-iron alloy is to be deposited, the anode may suitably be comprised of iron which itself will serve as a source of the iron ions in the bath.

In accordance with a further aspect of the process of the present invention, a rejuvenation of a trivalent electrolyte which has been rendered ineffective or inoperative due to the high concentration of hexavalent chromium ions is achieved by the addition of a controlled effective amount of the vanadium reducing agent. Depending upon the specific composition of the trivalent electrolyte, it may also be necessary to add or adjust other constituents in the bath within the broad usable or preferred ranges as hereinbefore specified to achieve optimum plating performance. For example, the rejuvenant may comprise a concentrate containing a suitable vanadium salt in further combination with halide salts, ammonium salts, borates, and conductivity salts as may be desired or required. The addition of the vanadium reducing agent can be effected as a dry salt or as an aqueous concentrate in the presence of agitation to achieve uniform mixing. The time necessary to restore the electrolyte to efficient operation will vary depending upon the concentration of the detrimental hexavalent chromium present and will usually range from a period of only five minutes up to about two or more hours. The rejuvenation treatment can also advantageously employ an electrolytic treatment of the bath following addition of the rejuvenant by subjecting the bath to a low current density of about 10 to about 30 ASF for a period of about 30 minutes to about 24 hours to effect a conditioning or so-called "dummying" of the bath before commercial plating operations are resumed. The concentration of the vanadium ions to achieve rejuvenation can range within the same limits as previously defined for the operating electrolyte.

In order to further illustrate the composition and process of the present invention, the following specific examples are provided. It will be understood that the examples are provided for illustrative purposes and are not intended to be limiting of the invention as herein disclosed and as set forth in the subjoined claims.

A series of trivalent chromium electrolytes are prepared having compositions as set forth in Table 1.

TABLE 1A

| INGREDIENT | EXAMPLE NO. - CONCENTRATION, G/L | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| $Cr^{+3}$ ions | 20 | 20 | 26 | 20 | 20 | 20 | 26 | 20 | 20 | 26 | 20 | 20 |
| Ammonium Formate | 40 | 40 | 50 | 40 | 40 | 40 | 50 | 40 | 40 | 50 | 40 | 40 |
| Potassium Formate | — | — | — | — | — | — | — | — | — | — | — | — |
| Vanadyl Sulfate | 2 | 2 | 2 | 2 | 2 | 2 | 2 | 2 | 2 | 2 | 2 | 2 |
| Sodium Sulfate | 142 | — | — | — | — | 142 | 76 | 142 | 142 | 76 | 142 | 142 |
| Ammonium Sulfate | — | 132 | — | — | — | 132 | — | — | — | 66 | 132 | 132 |
| Sodium Chloride | — | — | — | — | — | — | — | — | — | — | — | — |
| Potassium Chloride | — | — | — | — | — | — | — | — | — | — | — | — |
| Ammonium Chloride | 25 | 25 | 90 | 90 | 90 | 25 | 90 | 25 | 25 | 90 | 25 | 25 |
| Ammonium Bromide | 0.5 | 0.5 | 0.5 | 0.5 | 0.5 | 0.5 | 0.5 | 0.5 | 0.5 | 0.5 | 0.5 | 0.5 |
| Sodium Fluborate | — | — | 110 | — | — | — | 110 | — | — | 110 | — | — |
| Ammonium Sulfamate | — | — | — | 114 | — | — | — | 114 | — | — | 114 | |
| Ammonium Methane Sulfonate | — | — | — | — | 113 | — | — | — | 113 | — | — | 113 |
| Boric Acid | 45 | 45 | 45 | 45 | 45 | 45 | 45 | 45 | 45 | 45 | 45 | 45 |
| Surfactant | .1 | .1 | .1 | .1 | .1 | .1 | .1 | .1 | .1 | .1 | .1 | .1 |
| pH | 2.5–4.0 | 2.5–4.0 | 2.5–5.5 | 2.5–4.0 | 2.5–4.0 | 2.5–4.5 | 2.5–5.2 | 2.5–4.0 | 2.5–4.0 | 2.5–5.2 | 2.5–4.0 | 2.5–4.0 |

TABLE 1B

| INGREDIENT | EXAMPLE NO. - CONCENTRATION, G/L | | | | | | | | | | | |
|---|---|---|---|---|---|---|---|---|---|---|---|---|
| | 13 | 14 | 15 | 16 | 17 | 18 | 19 | 20 | 21 | 22 | 23 | 24 |
| $Cr^{+3}$ ions | 26 | 26 | 20 | 26 | 26 | 26 | 20 | 26 | 20 | 26 | 20 | 26 |
| Ammonium Formate | 50 | 50 | 40 | 50 | 50 | 50 | 40 | 50 | 40 | 50 | 40 | 50 |
| Potassium Formate | — | — | — | — | — | — | — | — | — | — | — | — |
| Vanadyl Sulfate | 2 | 2 | 2 | 2 | 2 | 2 | 2 | 2 | 2 | 2 | 2 | 2 |
| Sodium Sulfate | 76 | 76 | 142 | 76 | 76 | — | — | — | — | — | — | — |
| Ammonium Sulfate | — | — | — | 66 | 66 | 132 | 132 | 66 | 132 | 66 | 132 | 66 |
| Sodium Chloride | — | — | — | — | — | — | — | — | 25 | 25 | 25 | 25 |
| Potassium Chloride | — | — | — | — | — | — | — | — | — | — | — | — |
| Ammonium Chloride | 90 | 90 | 25 | 90 | 90 | 90 | 25 | 90 | — | — | — | — |
| Ammonium Bromide | 0.5 | 0.5 | 0.5 | 0.5 | 0.5 | 0.5 | 0.5 | 0.5 | 0.5 | 0.5 | 0.5 | 0.5 |
| Sodium Fluoborate | 110 | 110 | — | 110 | 110 | 110 | — | 110 | — | 110 | — | 110 |
| Ammonium Sulfamate | 114 | — | 114 | 60 | 60 | — | 114 | 114 | — | — | 114 | 55 |
| Ammonium Methane Sulfonate | — | 113 | 113 | — | 55 | — | — | — | 113 | 113 | 113 | 55 |
| Boric Acid | 45 | 45 | 45 | 45 | 45 | 45 | 45 | 45 | 45 | 45 | 45 | 45 |
| Surfactant | .1 | .1 | .1 | .1 | .1 | .1 | .1 | .1 | .1 | .1 | .1 | .1 |
| pH | 2.5–5.5 | 2.5–5.5 | 2.5–4.0 | 2.5–5.5 | 2.5–5.5 | 2.5–5.5 | 2.4–4.0 | 2.5–5.5 | 2.5–4.0 | 2.5–5.5 | 2.5–4.0 | 2.5–5.5 |

TABLE 1C

| INGREDIENT | EXAMPLE NO. - CONCENTRATION, G/L | | | | | | | | | | | |
|---|---|---|---|---|---|---|---|---|---|---|---|---|
| | 25 | 26 | 27 | 28 | 29 | 30 | 31 | 32 | 33 | 34 | 35 | 36 |
| $Cr^{+3}$ ions | 26 | 26 | 26 | 20 | 20 | 20 | 20 | 20 | 20 | 26 | 26 | 23 |
| Ammonium Formate | 50 | 50 | 50 | 40 | 40 | 40 | 40 | 40 | 80 | 50 | 50 | — |
| Potassium Formate | — | — | — | — | — | — | — | — | — | — | — | 80 |
| Vanadyl Sulfate | 2 | 2 | 2 | 2 | 2 | 2 | 4 | 4 | 4 | 2 | 2 | 2 |
| Sodium Sulfate | — | — | — | — | 142 | — | 142 | 142 | 142 | — | — | — |
| Ammonium Sulfate | — | — | — | — | — | 132 | — | — | — | — | — | — |
| Sodium Chloride | — | — | — | — | — | — | — | — | — | — | — | — |
| Potassium Chloride | — | — | — | — | — | — | — | — | — | 74 | 74 | 76 |
| Ammonium Chloride | 90 | 90 | 90 | 50 | 90 | 90 | 90 | 80 | 80 | 90 | 90 | 55 |
| Ammonium Bromide | 0.5 | 0.5 | 0.5 | 0.5 | 0.5 | 0.5 | — | 0.2 | — | — | 0.5 | — |
| Sodium Fluoborate | 110 | 110 | 110 | — | — | — | — | — | — | — | — | — |
| Ammonium Sulfamate | 114 | — | 55 | 114 | — | — | — | — | — | — | — | — |
| Ammonium Methane Sulfonate | — | 113 | 55 | 113 | — | — | — | — | — | — | — | — |
| Boric Acid | 45 | 45 | 45 | 45 | 45 | 45 | 40 | 40 | 40 | 45 | 45 | 45 |
| Surfactant | .1 | .1 | .1 | .1 | .1 | .1 | .1 | .1 | .1 | .1 | .1 | .1 |
| pH | 2.5–5.5 | 2.5–5.5 | 2.5–5.5 | 2.5–4.0 | 2.5–4.0 | 2.5–4.0 | 2.5–4.0 | 2.5–4.0 | 2.5–4.0 | 2.5–4.0 | 2.5–4.0 | 2.5–4.0 |

The particular sequence of addition of the bath constituents during bath make-up is not critical in achieving satisfactory performance. In all of the examples with the exception of Examples 34 and 35, the trivalent chromium ions are introduced in the form of chromium sulfate. In Examples 34 and 35, the trivalent chromium constituent is introduced employing chromium chloride hexahydrate. In each of the examples, the surfactant employed comprises a mixture of dihexyl ester of sodium sulfo succinic acid and sodium sulfate derivative of 2-ethyl-1-hexanol. The operating temperature of the exemplary electrolytes is from 70° to about 80° F. (21°–27° C.) at cathode current densities of from about 100 to about 250 ASF and an anode current density of about 50 ASF. The electrolytes are employed using a graphite anode at an anode to cathode ratio of about 2:1. The electroplating bath is operated employing a mild air and/or mechanical agitation. It has been found advantageous in some of the examplary bath formulations to subject the bath to an electrolytic preconditioning at a low current density, e.g. about 10 to about 30 ASF for a period up to about 24 hours to achieve satisfactory plating performance at the higher normal operating current densities.

Each of Examples 1–36 employed under the foregoing conditions produced full bright and uniform chromium deposits having good to excellent coverage over the current density ranges employed including good coverage in the deep recess areas of the J-type panels employed for test plating.

EXAMPLE 37

This example demonstrates the effectiveness of the vanadium compound for rejuvenating trivalent chromium electrolytes which have been rendered unacceptable or inoperative because of an increase in hexavalent chromium concentration to an undesirable level. It has been found by test that the progressive build-up of hexavalent chromium concentration will eventually produce a skipping of the chromium plate and ultimately will result in the prevention of any chromium plate deposit. Such tests employing typical trivalent chromium electrolytes to which hexavalent chromium is intentionally added has evidenced that a concentration of about 0.47 g/l of hexavalent chromium results in plating deposits having large patches of dark chromium plate and smaller areas which are entirely unplated. As the hexavalent chromium concentration is further increased to about 0.55 g/l according to such tests, further deposition of chromium on the substrate is completely prevented. The hexavalent chromium concentration at which plating ceases will vary somewhat depending upon the specific composition of the electrolyte.

In order to demonstrate a rejuvenation of a hexavalent chromium contaminated electrolyte, a trivalent chromium bath is prepared having the following composition:

| Ingredient | Concentration, g/l |
|---|---|
| Sodium fluoborate | 110 |
| Ammonium Chloride | 90 |
| Boric Acid | 50 |
| Ammonium formate | 50 |
| $Cr^{+3}$ ions | 26 |
| Surfactant | 0.1 |

The bath is adjusted to a pH between about 3.5 and 4.0 at a temperature of about 80° to about 90° F. S-shaped nickel plated test panels are plated in the bath at a current density of about 100 ASF. After each test run, the concentration of hexavalent chromium ions is increased from substantially 0 in the original bath by increments of about 0.1 g/l by the addition of chromic acid. No detrimental effects in the chromium plating of the test panels was observed through the range of hexavalent chromium concentration of from 0.1 up to 0.4 g/l. However, as the hexavalent chromium concentration was increased above 0.4 g/l large dark chromium deposits along with small areas devoid of any chromium deposit were observed on the test panels. As the concentration of hexavalent chromium attained a level of 0.55 g/l no further chromium deposit could be plated on the test panel.

Under such circumstances, it has heretofore been common practice to dump the bath containing high hexavalent chromium necessitating a make-up of a new bath which constitutes a costly and time consuming operation.

To demonstrate the rejuvenation aspects of the present invention, vanadium ions were added in increments of about 0.55 g/l to the bath containing 0.55 g/l hexavalent chromium ions and a plating of the test panels was resumed under the conditions as previously described. The addition of 0.55 g/l of vanadium ions corresponds to 2.6 g/l of vanadyl sulfate and corresponds to an incremental weight ratio addition of vanadium ions to hexavalent chromium ions of about 1:1.

The initial addition of 0.55 g/l vanadium ions to the bath contaminated with 0.55 g/l hexavalent chromium ions resulted in a restoration of the efficiency of the chromium plating bath producing a good chromium deposit of good color and coverage although hexavalent chromium ions were still detected as being present in the bath.

The further addition of 0.55 g/l vanadium ions produced a further improvement in the chromium deposit and analysis indicates the presence of a small amount of hexavalent chromium in the bath.

Finally, the addition of a further 0.55 g/l vanadium ions for a total of 1.65 g/l vanadium ions to the bath resulted in an excellent chromium deposit and an analysis for hexavalent chromium was negative. These test results clearly demonstrate the efficacy of vanadium as a rejuvenating agent for contaminated trivalent chromium plating baths.

EXAMPLE 38

In order to further demonstrate the process for rejuvenating trivalent chromium baths contaminated with hexavalent chromium, a trivalent chromium plating bath is prepared of the composition as described in Example 37 to which 1.65 g/l of hexavalent chromium is added corresponding to a concentration approximately three times the amount at which tests indicated a deposition of chromium ceased.

A test panel is plated under conditions as previously described in Example 37 clearly evidencing complete failure to deposit any chromium on the test panel. Thereafter, 4.95 g/l of vanadium ions corresponding to 23.5 g/l of vanadyl sulfate is added to the bath which is calculated to reduce all of the hexavalent chromium present to the trivalent state.

Following the addition of the vanadium rejuvenation agent, the bath under agitation was permitted to stand for approximately ten minutes after which a test panel was plated under the conditions as previously described in Example 37. It was observed that the test panel exhibited a trace of chromium plate on the surface thereof.

After waiting a total of forty-five minutes following the vanadium addition to the bath, a second test panel is plated evidencing an improved chromium plating with an increase in thickness and better appearance.

The bath is thereafter electrolyzed at a low current density of about 30 ASF for an additional three hours and a third test panel is plated. The chromium deposit is observed to be fully bright, of good color, with some thin deposit in low current density areas.

The bath is further electrolyzed at a low current density of 30 ASF for an additional seventeen hour period after which a fourth test panel is plated resulting in a chromium deposit of good thickness, fully bright with thin areas in the low current densities.

The test solution is replenished to return the concentration of the constituents as originally provided prior to the hexavalent and vanadium addition including the addition of 3 g/l of trivalent chromium ions and a fifth test panel is plated. The resultant panel is observed to have a fully bright chromium plating of good color with substantially complete coverage over the entire surface thereof including low current density areas.

It should be appreciated that the efficacy of the vanadium compound to rejuvenate trivalent chromium baths contaminated with hexavalent chromium is applicable for a wide variety of such trivalent chromium electrolytes and is not specifically restricted to the electrolyte as set forth in Example 37 and 38.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous acidic trivalent chromium electrolyte containing trivalent chromium ions, a complexing agent for maintaining the trivalent chromium ions in solution, halide ions, ammonium ions, hydrogen ions to provide a pH on the acid side, and a reducing agent comprising vanadiums ions present in at least an amount effective to maintain the concentration of hexavalent chromium ions at a level which is not in excess of 0.4 grams/liter.

2. The electrolyte defined in claim 1 in which said trivalent chromium ions are present in an amount of about 0.2 to 0.8 molar.

3. The electrolyte as defined in claim 1 in which said trivalent chromium ions are present in an amount of about 0.4 to about 0.6 molar.

4. The electrolyte as defined in claim 1 in which said complexing agent is present in a molar ratio of complexing agent to chromium ions of from about 1:1 to about 3:1.

5. The electrolyte as defined in claim 1 in which said complexing agent is present in a molar ratio of complexing agent to chromium ions of from about 1.5:1 to about 2:1.

6. The electrolyte as defined in claim 1 in which said vanadium ions are present in an amount of about 0.015 to about 6.3 g/l.

7. The electrolyte as defined in claim 1 in which said vanadium ions are present in an amount of about 0.2 to about 1 g/l.

8. The electrolyte as defined in claim 1 in which said ammonium ions are present in an amount to provide a molar ratio of ammonium ions to chromium ions ranging from about 2.0:1 to about 11:1.

9. The electrolyte as defined in claim 1 in which said ammonium ions are present in an amount to provide a molar ratio of ammonium ions to chromium ions ranging from about 3:1 to about 7:1.

10. The electrolyte as defined in claim 1 in which said halide ions are present in an amount to provide a molar ratio of halide ions to chromium ions of from about 0.8:1 to about 10:1.

11. The electrolyte as defined in claim 1 in which said halide ions are present in an amount to provide a molar ratio of halide ions to chromium ions of from about 2:1 to about 4:1.

12. The electrolyte as defined in claim 10 or 11 wherein said halide ions comprise chloride ions, bromide ions, and mixtures thereof present in an amount of at least about 15 g/l.

13. The electrolyte as defined in claim 1 further containing conductivity salts.

14. The electrolyte as defined in claim 13 in which said conductivity salts are present in an amount up to about 300 g/l.

15. The electrolyte as defined in claim 1 further containing borate ions.

16. The electrolyte as defined in claim 15 in which said borate ions are present in an amount of at least about 10 g/l.

17. The electrolyte as defined in claim 15 in which said borate ions are present in an amount up to about 60 g/l.

18. The electrolyte as defined in claim 1 further containing a buffering agent in an amount of about 0.15 molar up to bath solubility.

19. The electrolyte as defined in claim 18 in which said buffering agent is present in an amount of about 0.45 to about 0.75 molar.

20. The electrolyte as defined in claim 1 further including a buffering agent comprising boric acid and the alkali metal and ammonium salts thereof as well as mixtures thereof.

21. The electrolyte as defined in claim 1 further containing a surfactant.

22. The electrolyte as defined in claim 21 in which said surfactant is present in an amount of about 0.05 to about 1 g/l.

23. The electrolyte as defined in claim 1 in which said hydrogen ions are present to provide a pH of about 2.5 to about 5.5.

24. The electrolyte as defined in claim 1 in which said hydrogen ions are present in an amount to provide a pH of about 3.5 to about 4.0.

25. The electrolyte as defined in claim 1 in which said trivalent chromium ions are present in an amount of about 0.2 to about 0.8 molar, said complexing agent is present in a molar ratio of complexing agent to chromium ions of about 1:1 to about 3:1, said halide ions are present in a molar ratio of halide ions to chromium ions of about 0.8:1 to about 10:1, said ammonium ions are present in a molar ratio of ammonium ions to chromium ions of about 2.0:1 to about 11:1, said hydrogen ions are present in an amount to provide a pH of about 2.5 to about 5.5, and said vanadium ions are present in an amount of about 0.015 to about 6.3 g/l.

26. The electrolyte as defined in claim 1 in which said trivalent chromium ions are present in an amount of about 0.4 to about 0.6 molar, said complexing agent is present in a molar ratio of complexing agent to chromium ions of about 1.5:1 to about 2:1, said halide ions are selected from the group consisting of chloride, bromide and mixtures thereof present in an amount to provide a molar ratio of halide ions to chromium ions of about 2:1 to about 4:1, said ammonium ions are present in an amount to provide a molar ratio of ammonium ions to chromium ions of about 3:1 to about 7:1, said hydrogen ions are present to provide a pH of about 3.5 to about 4.0 and said vanadium ions are present in an amount of about 0.2 to about 1 g/l.

27. A process for electroplating a chromium deposit on an electrically conductive substrate comprising the steps of immersing the substrate in an aqueous acidic trivalent chromium electrolyte as defined in claim 1, 2,

3, 4, 5, 6, 7, 8, 9, 10, 11, 13, 14, 15, 16, 17, 18, 19, 20, 21, 22, 23, 24, 25 or 26, applying a cathodic charge to said substrate to effect a progressive deposition of a chromium electrodeposit thereon, and continuing the electrodeposition of said chromium electrodeposit until the desired thickness is obtained.

28. The process for rejuvenating an aqueous acidic trivalent chromium electrolyte which has been impaired in effectiveness due to the contamination by excessive quantities of hexavalent chromium, said electrolyte containing trivalent chromium ions, a complexing agent for maintaining the trivalent chromium ions in solution, halide ions, ammonium ions and hydrogen ions to provide a pH on the acid side, said process comprising the steps of adding to said electrolyte a reducing agent comprising vanadiums ions in at least an amount sufficient to reduce the concentration of hexavalent chromium ions to a level which is not in excess of 0.4 grams/liter.

29. The process as defined in claim 28 in which said vanadium ions added are of a valence of $4^+$.

30. The process as defined in claim 28 in which said vanadium ions are added in an amount of about 0.015 to about 6.3 g/l.

31. The process as defined in claim 28 in which said vanadium ions are added in an amount of about 0.2 to about 1 g/l.

32. The process as defined in claim 28 in which said vanadium ions are added in an amount to reduce the hexavalent chromium ion concentration to a level below about 100 ppm.

33. The process as defined in claim 28 in which said vanadium ions are added in an amount to reduce the hexavalent chromium ion concentration to a level below about 50 ppm.

34. The process as defined in claim 28 in which said vanadium ions are introduced in the form of electrolyte soluble and compatible vanadium salts.

35. The process as defined in claim 28 including the further step of electrolyzing the electrolyte following the addition of said vanadium ions at a moderate current density to accelerate reduction of said hexavalent chromium ions by said vanadium ions.

* * * * *